United States Patent [19]

Wyslotsky et al.

[11] 4,427,705

[45] Jan. 24, 1984

[54] COMMESTIBLE PACKAGE

[75] Inventors: Ihor Wyslotsky; Erich Hoffmann, both of Alsip, Ill.

[73] Assignee: TEC, Inc., Alsip, Ill.

[21] Appl. No.: 263,872

[22] Filed: May 15, 1981

[51] Int. Cl.[3] ..... B65D 6/02

[52] U.S. Cl. ..... 426/106; 206/461; 206/467; 206/45.14; 206/45.16; 220/306; 220/4 B; 220/66; 220/70; 229/2.5 R; 229/43; 426/129; 426/130

[58] Field of Search ..... 426/129, 130, 106; 221/56, 58, 59, 64; 206/806, 817, 804, 825, 814, 591, 583, 521, 45.14, 45.16, 45.34, 461, 464, 467, 470, 471; 220/66, 306, 4 B, 70; 229/43, 2.5 R

[56] References Cited

U.S. PATENT DOCUMENTS

| | | | |
|---|---|---|---|
| 1,605,496 | 11/1926 | Barbieri | 221/59 |
| 2,754,959 | 7/1956 | McCarty | 426/129 |
| 2,798,631 | 7/1957 | Engel | 220/306 |
| 3,155,233 | 11/1964 | Tupper | 229/43 |
| 3,305,086 | 2/1967 | Hartman | 229/2.5 |
| 3,320,993 | 5/1967 | Motsenbocker | 229/43 |
| 3,410,698 | 11/1968 | Sosin | 426/106 |
| 3,454,158 | 7/1969 | Tigner | 426/129 |
| 3,464,618 | 9/1969 | Martelli et al. | 229/2.5 |
| 3,501,080 | 3/1970 | Govatsos | 229/2.5 |
| 3,556,337 | 1/1971 | Harmon et al. | 426/129 |
| 3,650,386 | 3/1972 | Tigner | 426/129 |
| 3,685,717 | 8/1972 | Seiferth | 426/129 |
| 3,833,742 | 9/1974 | Wetmore | 426/129 |
| 3,842,974 | 10/1974 | Jacobsen | 220/306 |
| 3,942,682 | 3/1976 | McKay | 221/58 |
| 3,982,651 | 9/1976 | Braun et al. | 220/306 |
| 4,016,972 | 4/1977 | Szamborski | 206/470 |
| 4,058,212 | 11/1977 | Wyslotsky | 206/470 |
| 4,114,761 | 9/1978 | Kleiner | 206/591 |
| 4,244,470 | 1/1981 | Burnham | 229/2.5 R |

*Primary Examiner*—Steven L. Weinstein
*Attorney, Agent, or Firm*—Robert M. Ward

[57] ABSTRACT

A package is disclosed for containing a commestible and includes an integrally formed plastic base member and an integrally formed plastic top member. The base member includes a centrally disposed commestible receptical defined by a commestible supporting bottom portion and side wall portions extending substantially perpendicularly therefrom, with the side wall portions being bounded by an upwardly projecting engagement lip. The side wall portions have on oppositely disposed sides side wall peak portions having a greater height, and normally thereto side wall valley areas having a lesser height. Extending substantially horizontally from the lip is a lip re-enforcement flange. The integrally formed top member includes a centrally disposed commestible containing portion bounded by structures which matingly engage with those of the base member to enclose the commestible. In preferred embodiments, the base member bottom portion includes a plurality of congruent corrugations, which may further include a radially disposed tacking corrugation for urging the base member bottom portion upwardly in a spring-like fashion to hold the commestible into a substantially snug fit with the planar portion of the top member. The tacking corrugation may include an evacuating surface for insertion of an evacuation needle for supplying a vacuum to the sealed package.

22 Claims, 5 Drawing Figures

COMMESTIBLE PACKAGE

BACKGROUND OF THE INVENTION

This invention relates to packaging and more particularly to a package for containing a comestible having matingly engaging integrally formed plastic base and top members, the base member of which may preferably include corrugated spring-like means for urging the comestible upwardly into a more prominent position for display and for efficiency of evacuation.

In the packaging of prepared meat and similar food products including sliced cheese, various package designs have been utilized in the art. Most frequently, such packages have been formed from a plastic material and have comprised engageable top and bottom portions, with at least the top portion being made from a transparent material for display of the comestible.

The purpose of such packaging is to store the comestible at a commercial outlet for the period prior to purchase, and to prevent deterioration of the contained comestible prior to purchase. Certain prior art comestible packages have included means for resealing the package after opening and partial consumption of the contained comestible.

Many such prior art packages have been vacuumized at the packing plant in order to provide a greater shelf life. In such vacuumized packages, excessive space within the package that is not filled by the comestible is thus available to be filled by air, which renders vacuumizing more difficult and renders more probable leakage of air into the package, which may result in deterioration of the comestible product contained therein.

A further difficulty of certain of the prior art packages has been in the means provided for resealing. In several of these prior art packages, the resealing means have been inadequate to seal the package against the free access of air therein, which has speeded the deterioration of the product, both by the growth of airborne bacteria and fungus and by loss of moisture.

Other prior art packages have been reasonably effective against the above disadvantages, but have been of relatively greater expense to produce, or have tended to promote product damage, or have been of relatively greater inconvenience in use, or have been of inadequate attractiveness for proper display of the product.

In view of the above disadvantages and limitations of prior art comestible packages, it is an object of the comestible package of the present invention to materially reduce and/or alleviate the same.

SUMMARY OF THE INVENTION

The comestible package of the present invention includes an integrally formed plastic base member and top member.

The base member has a centrally disposed comestible receptacle which has a transverse cross-sectional shape that is substantially congruent with the transverse cross-sectional shape of the comestible for substantially snug fit therewith. The comestible receptacle is defined by a bottom portion and substantially perpendicularly disposed side wall portions. An oppositely disposed pair of the side wall portions is of a greater height than the side wall portions disposed normally thereto, to form oppositely disposed side wall peak areas and side wall valley areas. An upwardly projecting lip is disposed around the entire perimeter of the side wall of the base member. An integrally formed lip re-enforcement flange projects exteriorly and substantially normally to the upwardly projecting lip throughout the entirely of the circumference thereof.

The integrally formed top member includes a substantially centrally disposed comestible cover for covering the comestible. The cover includes a planar portion for confining the top of the comestible and includes cover side wall portions connected to and extending downwardly and substantially perpendicularly from the planar portion. A lip engagement rim is disposed around the entire perimeter of the side wall portions of the top member and includes a top portion disposed normal to the side wall portions and a downwardly extending exterior rim wall. The lip engagement rim of the top member matingly engages the lip of the base member, and is accordingly of a size, shape and circumferential disposition with regard to the radial location of the side wall peak and valley areas for such mating engagement. An integrally formed lip engagement rim re-enforcement flange projects exteriorly of and substantially normal to the exterior rim wall of the lip engagement rim for mating engagement with the lip re-enforcement flange of the base member.

In some preferred embodiments of the comestible package of the present invention, the base member bottom portion includes a plurality of congruent corrugations disposed around the periphery of the base member bottom portion to permit the bottom portion to flex upwardly or downwardly to accommodate comestibles of various heights in order to provide a substantially snug fit of the comestible within the comestible package. A snug fit is necessary to provide a more prominent display of the comestible and a greater ease of evacuation, by reason of less air being present in the package.

In certain other preferred embodiments of the comestible package of the present invention, a tacking corrugation disposed radially to the congruent corrugations is provided in order to urge the spring-like bottom structure resiliently upwardly. Such tacking corrugation may preferably include an evacuating surface for insertion of an evacuation needle for applying a vacuum to the sealed package and for ease of sealing the evacuation hole left by the evacuation needle.

BRIEF DESCRIPTION OF THE DRAWING

Preferred embodiments of the comestible package of the present invention are shown by way of illustration in the accompanying drawing, wherein.

DETAILED DESCRIPTION OF PREFERRED EMBODIMENTS

Figure 1:
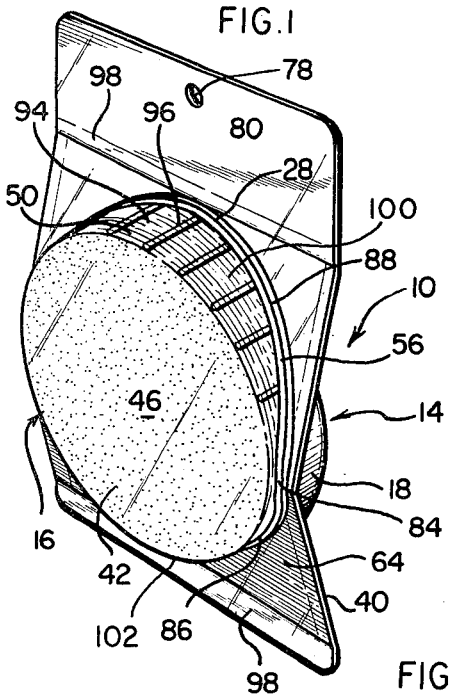
FIG. 1 is a perspective side and top view of the comestible package of the present invention showing the centrally disposed comestible cover of the transparent and integrally formed top member with downwardly extending side walls having re-enforcing corrugations thereon, and showing therebeneath (in speckled lines) the comestible product contained therein, further showing the engagement lip being engaged by the lip engagement rim of the top member, and yet further showing the integrally formed lip re-enforcement flange of the base member beneath the transparent integrally formed lip engagement rim re-enforcement flange of the top member.

The present invention is directed to a package for containing a comestible, such as for example and without limitation sliced-prepared luncheon meat, or sliced cheese. The comestible package of the present invention includes two basic parts—a base member and a top member. Each of the base member and top member is integrally formed of a plastic material.

The base member has a substantially centrally disposed comestible receptacle for receiving, supporting and enclosing the longitudinal bottom portion of the comestible. The comestible receptacle has a transverse cross-sectional shape which is substantially congruent with the transverse cross-sectional shape of the comestible and of even size therewith for a substantially snug fit of the comestible therein in order to provide a tightly fitting package with very little lateral space between the comestible and the respective package side walls. The reason therefor is to minimize the amount of air in the package for ease and reliability of evacuation.

The comestible receptacle of the base member has a comestible supporting bottom portion and side wall portions connected to the bottom portion and extending substantially perpendicular thereto. An oppositely disposed pair of side wall portions are of a greater height than the side wall portions disposed normally thereto to form oppositely disposed side wall peak areas and oppositely disposed side wall valley areas disposed normal thereto.

An upwardly projecting engagement lip is continuously disposed around the top of the side wall portions. The lip of the base member has an inside wall formed from the side wall of the base member, a lip top portion disposed substantially normal thereto and an exterior wall connected to the lip top portion and extending downwardly therefrom. In preferred embodiments, the exterior wall of the lip is disposed substantially parallel to the inside wall. The lip is of a substantial width for engagement with a mating structure on the top member. The lip of the base member further has at least one locking indentation in preferred embodiments formed in the exterior wall of the lip and preferably in a part of the lip disposed circumferentially from the side wall peak areas and in one or more of the side wall valley areas.

An integrally formed lip re-enforcement flange projects exteriorly of and substantially normal to the upwardly projecting lip for maintaining stability of the lip for efficient engagement with the top member and for providing lateral strength and crush resistance to the package. The lip re-enforcement flange preferably projects from the bottom of the lip exterior wall and throughout substantially the entirety of the circumference thereof.

The integrally formed top member is preferably formed from a transparent plastic material for displaying the comestible. The top member has a substantially centrally disposed comestible cover for covering and enclosing the longitudinal upper portion of the comestible, which cover has a transverse cross-sectional shape which is substantially congruent with the transverse cross-sectional shape of the comestible and of even size therewith for a substantially snug fit of the comestible therein. The comestible cover has a substantially planar portion for confining the top of the comestible and has cover side wall portions connected to and extending downwardly from the planar portion, and preferably perpendicularly therefrom. An oppositely disposed pair of the cover side wall portions are of a greater length than the side wall portions disposed normal thereto to form oppositely disposed top member side wall peak areas, and to form oppositely disposed side wall valley areas, which are respectively of a size, shape and circumferential disposition to correspond to those of the base member peak areas and base member valley areas.

A lip engagement rim having a rim top portion normally disposed and projecting outwardly from the bottom surface of the top member side wall and having an exterior rim wall extending downwardly from the rim top portion is provided. In preferred embodiments, the exterior rim wall extends substantially parallel to the cover portion side wall. The lip engagement rim has a size, shape and circumferential disposition for matingly engaging the lip of the base member.

In preferred embodiments, the lip engagement rim has at least one indentation disposed in the exterior rim wall, which indentations are of a size, shape and circumferential disposition for mating engagement with the locking indentations of the lip on the base member.

An integrally formed lip engagement rim re-enforcement flange projects exteriorly of and substantially normal to the bottom of the exterior rim wall of the lip engagement rim, and has a size, shape and disposition for mating engagement with the lip re-enforcement flange of the base member to increase the stability of the locking engagement between the base member and the top member.

It is contemplated that comestible packages of the present invention may preferably include on the base member bottom portion thereof a plurality of integrally formed congruent corrugations which are disposed around at least the periphery of the base member bottom portion. These congruent corrugations permit the bottom portion to flex upwardly or downwardly to accommodate variances in the longitudinal dimension of the comestible to be contained by the package, in order to provide a substantially snug fit of the comestible disposed between the bottom portion of the base member and the planar portion of the cover of the top member. The congruent corrugations may preferably be connected by at least one radially disposed tacking corrugation for urging the congruent corrugations in an upward direction thereby to form a spring-like bottom structure for urging the top of the comestible into substantial proximity to the planar portion of the cover of the top member. Thus, the congruent and radial corrugations provide a more prominent display of the comestible, and by reducing the space between the comestible and the top and bottom of the comestible package allow for more efficient evacuation of the comestible package. Also in preferred embodiments, the radial tacking corrugation preferably includes an evacuating surface, which may be disposed near the outermost of the congruent corrugations for insertion of an evacuation needle for supplying a vacuum to the sealed package, and for ease of resealing the needle hole.

In preferred embodiments of the comestible package of the present invention, the lip re-enforcement flange may include an aperture therein for hanging the package. In such embodiments, the lip re-enforcement flange is of extended length on one side of the comestible receptacle laterally of a side wall portion that is normal of a side wall peak area and adjacent a side wall valley area. In these embodiments, the aperture for hanging the comestible package is disposed in the extended length portion.

In some preferred embodiments of the comestible package of the present invention, the uppermost extremeties of the matingly engaging peak areas of the top member are disposed substantially in the plane of the planar portion of the cover of the top member. In such embodiments the matingly engaging peak areas of the top member are preferably of a truncated shape to extend in plan view a substantial distance around the perimeter of the cover of the top member, rather than being of a pointed shape, for improved engagement between the lip of the base member and the lip engagement rim of the top member. In these and other preferred embodiments of the comestible package of the present invention, the lip engagement rim and the mating lip have no acute angles, with the result that engagement therebetween is enhanced.

In some preferred embodiments, the comestible receptacle of the base member and the cover of the top member are round in transverse cross-sectional shape. In other preferred embodiments, the comestible receptacle of the base member and the cover of the top member are square in transverse cross-sectional shape. Of course, the transverse cross-sectional shape of the container is selected to match the size, shape and contours of the comestible to be contained therein, and accordingly yet other transverse cross-sectional shapes are contemplated and may be utilized.

In embodiments using the round transverse cross-sectional shape, the lip of the base member comprises two lip portions which are of the shape of an arc of a circle. These lip portions are disposed around the side walls of the base member and extend upwardly at the cord portion of the arc, with such cords lying in substantially the same plane. In such embodiments, the arc-shaped lip portions are respectively disposed within planes which planes intersect each other preferably at an obtuse angle. In yet other preferred embodiments of the comestible package of the present invention, the lip re-enforcement flange and the lip engagement rim re-enforcement flange respectively extend upwardly and on oppositely disposed sides respectively of the base member and the top member. In these embodiments, the lip re-enforcement flange and the lip engagement rim re-enforcement flange form an engaging lip re-enforcement flange peak and a lip engagement rim re-enforcement flange peak which is disposed adjacent the respective side wall peak areas. These peaks are disposed on the lateral sides of the package in plan view.

In other preferred embodiments of the comestible package of the present invention, the cover side wall portions of the top member preferably include corrugations therein to increase the resistence of the package to longitudinal compression. A plurality of circumferential corrugations is disposed in spaced array on the cover side walls and plurality of longitudinal corrugations is provided in intersecting disposition therewith.

Figure 5:
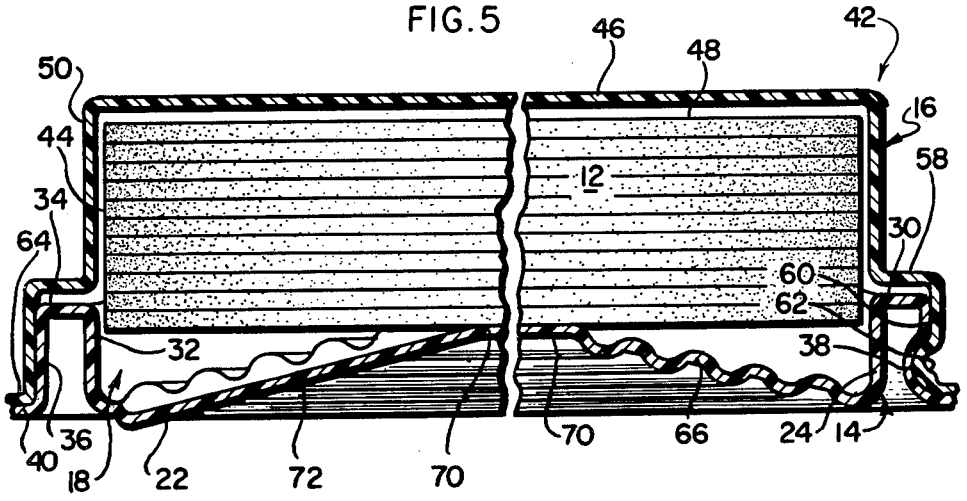
FIG. 5 is a further enlarged fragmented longitudinal cross-sectional view taken along line 5—5 of FIG. 4 showing the top member engaging the base member at the respective locking indentations on the lip and at the engaging rim, and further showing in the left side of the section a cross-sectional view of the tacking corrugation through the congruent corrugations, and particularly illustrating the upwardly urging engagement of the congruent corrugations with the comestible product, and yet further showing in the right side of the section a cross-sectional view through a locking indentation.

Referring now to the drawing in which common numerals are used throughout for designating common elements, and to FIG. 1 in particular, the present invention is directed to a package generally 10 for containing a comestible 12, which may be sliced as shown in FIG. 5. The comestible package 10 of the present invention includes a base member generally 14 and an engaging top member generally 16. Each of base member 14 and top member 16 is integrally formed of a plastic material, and preferably a thermoformable plastic material.

Figure 3:
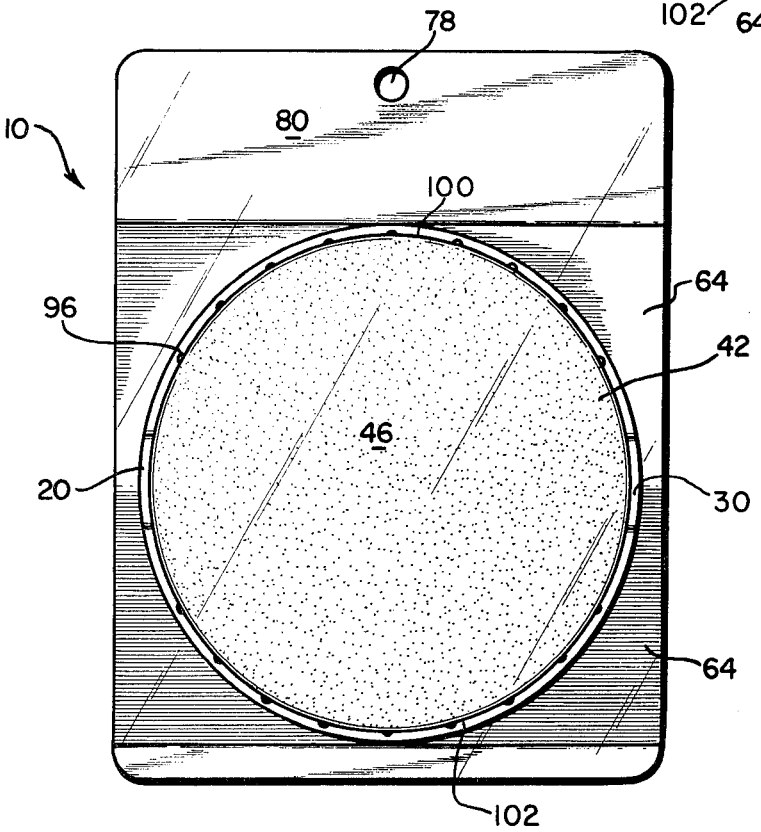
FIG. 3 is an enlarged plan view of the comestible package of the present invention showing the centrally disposed planar portion of the top member with the comestible contained therein and showing through, and further showing the surrounding flanges of the top and base members, with one flange being of extended length for providing a hanging hole.

Base member 14 has a substantially centrally disposed comestible receptacle generally 18 for receiving and supporting comestible 12. Comestible receptacle 18 has a transverse cross-sectional shape which is substantially congruent with the transverse cross-sectional shape of comestible 12 for a substantially snug fit of the comestible therein in order to provide a tightly fitting package with very little lateral space 20 between comestible 12 and package 10, as shown in FIGS. 3 and 5.

Figure 2:
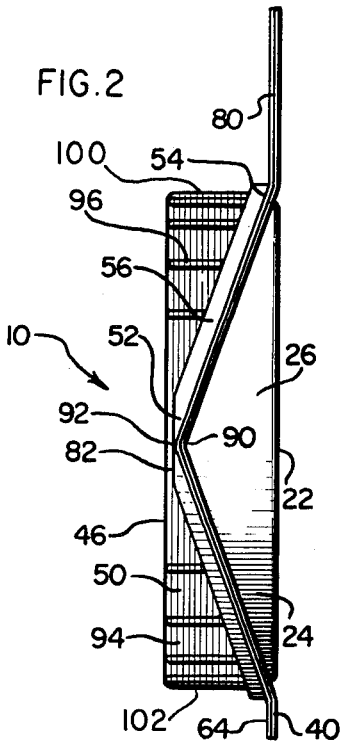
FIG. 2 is an enlarged side view of the comestible package of the present invention showing the top member with intersecting and re-enforcing corrugations disposed atop the base member and engaging the base member at the lip thereof and also showing such engagement at one of the side wall peak areas.

Comestible receptacle 18 of base member 14 has a comestible supporting bottom portion 22 and side wall portions 24 connected to bottom portion 22 and extending substantially perpendicular thereto as particularly shown in FIGS. 2 and 5. An oppositely disposed pair of side wall portions 24 are of a greater height than side wall portions 24 disposed normally thereto to form oppositely disposed side wall peak areas 26 as shown in FIG. 2 and oppositely disposed side wall valley areas 28 disposed normal thereto as shown in FIG. 1.

The side wall peak and valley areas 26, 28 function to perform and comprise means for resisting crushing of the package 10 from the top and bottom of package 10 and specifically from base member 14 and engaging top member 16. Side wall peak and valley areas 26, 28 further function for guiding comestible 12 into package 10 during filling thereof. Side wall peak and valley areas 26, 28 further function to provide oppositely disposed access means 100, 102 in order that a portion of the comestible 12 may be withdrawn from the package. Yet further, side wall peak and valley areas 26, 28 hold the bulk of comestible 12 therein upon opening package 10 and upon removal of a portion of comestible 12 because such peak areas extend upwardly on either side of the comestible contents of the package 10 as shown in FIGS. 1 and 2 in particular.

Figure 4:
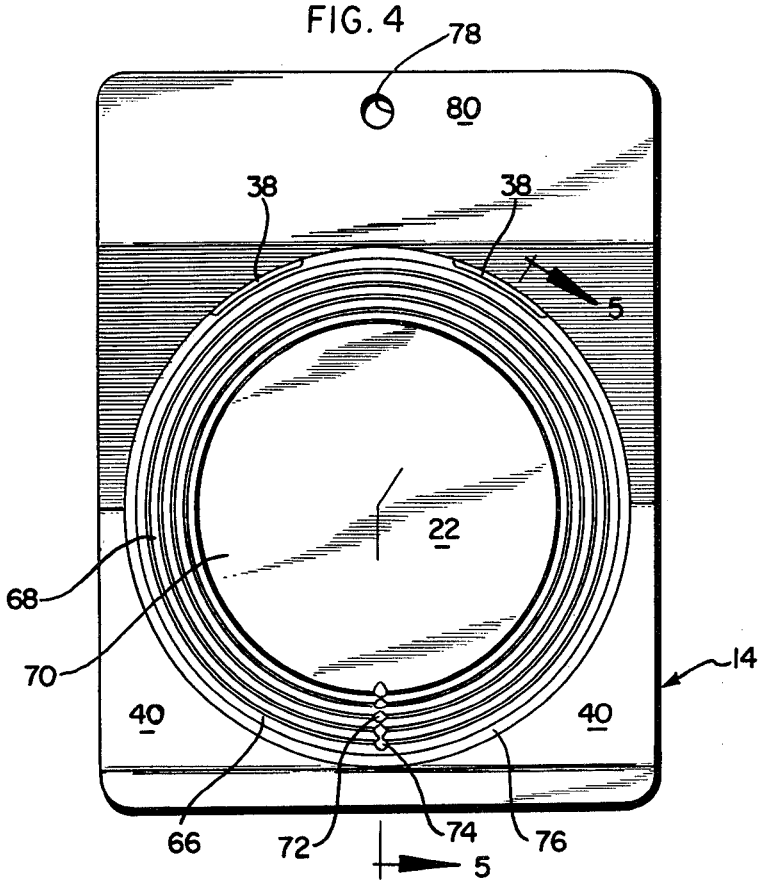
FIG. 4 is a bottom view of the comestible package of the present invention showing the congruent spring-like corrugations which are intersected by a radial tacking corrugation for urging the congruent corrugations upwardly and also showing a pair of locking indentations to effect securement between the engaging top and base members.

An upwardly projecting engagement lip 30 is continuously disposed around the top of side wall portions 24. Lip 30 of base member 14 has an inside wall 32 formed from side wall 24 of base member 14, a lip top portion 34 disposed substantially normal thereto and an exterior wall 36 connected to lip top portion 34 and extending downwardly therefrom as shown particularly in the left side section of FIG. 5. In preferred embodiments, exterior wall 36 of lip 30 is disposed substantially parallel to inside wall 32. Lip 30 is of a substantial width for engagement with a mating structure on top member 16. Lip 30 of base member 14 further has at least one locking indentation 38 in preferred embodiments formed in exterior wall 36 of lip 30 as shown in FIG. 4 and in the right side section of FIG. 5 and in a part of lip 30 disposed circumferentially from side wall peak areas 26 and in one or more of the side wall valley areas 28.

Lip 30 of base member 14 extends in a substantially uniform width around inside wall 32 as seen in FIG. 3. As noted and as observed in FIGS. 1–5, the polymeric material from which the top portion of the package is formed is preferably transparent. Lip 30, including its inside wall 32 formed from side wall 24 and exterior wall 36, particularly as shown in FIG. 5, provides further stiffening.

An integrally formed lip re-enforcement flange 40 projects exteriorly of and substantially normal to upwardly projecting lip 30. Lip re-enforcement flange 40 preferably projects from the bottom of lip exterior wall 36 and throughout substantially the entirety of the circumference thereof.

The integrally formed top member 16 is preferably formed from a transparent plastic material for displaying comestible 12 as shown particularly in FIGS. 1 and 3. As shown particularly in FIG. 5, top member 16 has a substantially centrally disposed comestible cover 42 for covering comestible 12, which cover 42 has a transverse cross-sectional shape which is substantially congruent with the transverse cross-sectional shape of comestible 12 for a substantially snug fit of comestible 12 therein by allowing very little lateral space 44. Comestible cover 42 has a substantially planar portion 46 for confining the top 48 of comestible 12 and has cover side wall portions 50 connected to and extending downwardly from planar portion 46, and preferably perpendicularly therefrom. An oppositely disposed pair of cover side wall portions 50 are of a greater length than side wall portions 50 disposed normal thereto to form oppositely disposed top member side wall peak areas 52 and oppositely disposed side wall valley areas 54 as shown in FIG. 2.

A lip engagement rim 56 having a rim top portion 58 normally disposed and projecting outwardly from the bottom surface of cover portion side wall 50 and having an exterior rim wall 60 extending downwardly from the rim top portion is provided. In preferred embodiments, exterior rim wall 60 extends substantially parallel to cover portion side wall 50. Lip engagement rim 56 has a size, shape and circumferential disposition for matingly engaging lip 30 of base member 14.

In preferred embodiments, lip engagement rim 56 has at least one indentation 62 formed in exterior rim wall 60 and which is of a size, shape and circumferential disposition for mating engagement with and locking with indentations 38 of lip 30 on base member 14, as shown in the right side section of FIG. 5.

An integrally formed lip engagement rim re-enforcement flange 64 projects exteriorly of and substantially normal to the bottom of exterior rim wall 60 of lip engagement rim 56, and has a size, shape and disposition for mating engagement with lip re-enforcement flange 40 of base member 14.

It is contemplated that comestible packages 10 of the present invention may preferably include on base member bottom portion 22 thereof a plurality of integrally formed congruent corrugations 66 as shown in FIGS. 4 and 5 which are disposed around at least the periphery 68 of base member bottom portion 22. These congruent corrugations permit the middle area 70 of bottom portion 22 to flex upwardly and downwardly to accommodate variances in the longitudinal dimension of comestible 12 to be contained by package 10 in order to provide a substantially snug fit of comestible 12 disposed between middle area 70 of bottom portion 22 of base member 14 and planar portion 46 of cover 42 of top member 16. Congruent corrugations 66 may preferably be connected by at least one radially disposed tacking corrugation 72 as shown in FIGS. 4 and 5 for urging congruent corrugations 66 in an upward direction thereby to form a spring-like bottom structure for urging the top 48 of comestible 12 into substantial proximity to planar portion 46 of cover 42. Thus, the congruent and radial corrugations 66, 72 provide for a more prominent display of comestible 12 and, by reducing the space between comestible 12 and planar portion 46 and bottom portion 22 of comestible package 10 to allow for a greater ease of evacuation of comestible package 10. Also in preferred embodiments, radial tacking corrugation 72 preferably includes an evacuating surface 74 as shown in FIG. 4, which may be disposed near the outermost 76 of congruent corrugations 66 for insertion of an evacuation needle (not shown) for supplying a vacuum to the sealed package, and for ease of resealing the needle hole (not shown).

In preferred embodiments of comestible package 10 of the present invention, lip re-enforcement flange 40 may include an aperture 78 therein for hanging package 10. In such embodiments, lip re-enforcement flange 40 is of extended length on one side of the comestible receptacle 18 laterally of a side wall portion 24 that is normal of a side wall peak area 26 and adjacent a side wall valley area 28. In these embodiments, aperture 78 for hanging comestible package 10 is disposed in the extended length portion 80.

As shown in FIG. 2, in preferred embodiments of the comestible package 10 of the present invention, the uppermost extremeties 82 of the matingly engaging peak areas 52 of top member 16 are disposed substantially in the plane of the planar portion 46 of cover 42 of top member 16. In such embodiments, the matingly engaging peak areas 52 of top member 16 are preferably of a truncated shape to extend a substantial distance 84 around the perimeter of cover 42 of top member 16 as shown in FIGS. 1 and 2, for improved engagement between lip 30 of base member 14 and lip engagement rim 56 of top member 16.

In other preferred embodiments of comestible package 10 of the present invention, lip engagement rim 56 and mating lip 30 have no acute angles, with the result that engagement therebetween is enhanced.

In some preferred embodiments, comestible receptacle 18 of base member 14 and cover 42 of top member 16 are round in transverse cross-sectional shape, as shown in FIGS. 1–5. In other preferred embodiments, comestible receptacle 18 of base member 14 and cover 42 of top member 16 may be square in transverse cross-sectional shape. Of course, the transverse cross-sectional shape of the container is selected to match the size, shape and contours of comestible 12 to be contained therein, and accordingly yet other transverse cross-sectional shapes may be utilized.

In embodiments using the round transverse cross-sectional shape, lip 30 of base member 14 comprises two lip portions 86, 88 as shown in FIG. 1, which are of the shape of an arc of a circle. Lip portions 86, 88 are disposed around side walls 24 of base member 14 and extend upwardly at the cord portion of the arc, with such cords lying in substantially the same plane, as shown in FIGS. 1 and 2. In such embodiments, the arc-shaped lip portions 86, 88 are respectively disposed within planes which planes intersect each other preferably at an obtuse angle. In yet other preferred embodiments of comestible package 10 of the present invention, lip re-enforcement flange 40 and lip engagement rim re-enforcement flange 64 respectively extend upwardly and on oppositely disposed sides respectively of base member 14 and top member 16. In these embodiments, the lip re-enforcement flange 40 and the lip engagement rim re-enforcement flange 64 form an engaging lip re-enforcement flange peak 90 and a lip engagement rim re-enforcement flange peak 92. These peaks 90, 92 are disposed on the lateral sides of package 10.

In other preferred embodiments of comestible package 10 of the present invention, cover side wall portions 50 of top member 16 preferably include corrugations therein to increase the resistence of package 10 to longitudinal compression. A plurality of circumferential corrugations 94 are disposed in spaced array on cover side walls 50 and an intersecting plurality of longitudinal corrugations 96 are further provided.

Various means for receiving base member 14 and top member 16 together to form package 10 are contemplated, and may preferably comprise a hot melt or other glue as illustrated by the continuous glue line 98 shown in FIG. 1 extending around the peripheries of respective flanges 40, 64 of base member 14 and top member 16. Although such a glue line 98 is utilized in certain preferred embodiments, as it permits the use of the generally less expensive non-thermofusable plastic materials for base member 14 and top member 16, it is contemplated that heat fusable plastics may be used in other preferred embodiments, in which event the glue line 98 would be replaced by a heat seal fusing together with the peripheries of the respective flanges 40, 64.

It is also contemplated that package 10 may contain an inert gas, such as nitrogen, which is back-flushed after evacuation of package 10.

The basic and novel characteristics of a comestible package of the present invention will be readily understood from the foregoing disclosure by those skilled in the art. It will become readily apparent that various changes and modifications may be made in the form, construction and arrangement of a comestible package of the present invention as set forth hereinabove without departing from the spirit and scope of the invention. Accordingly, the preferred and alternative embodiments of the present invention set forth hereinabove are not intended to limit such spirit and scope in any way.

What is claimed is:

1. In an evacuated package containing a comestible having a longitudinal dimension, said package having a top member, said top member including a generally planar cover portion for covering the top of the comestible, and a base member for engaging said top member, said base member having a bottom portion for supporting the comestible, the improvement comprising:

a plurality of integrally formed congruent corrugations disposed about at least the periphery of said base member bottom portion, to permit said bottom portion to flex to accommodate variances in the longitudinal dimension of the comestible to be contained by the package; and at least one tacking corrugation disposed radially across and connecting said congruent corrugations for urging said congruent corrugations upwardly to form a spring-like bottom structure for urging the top of the comestible into substantial proximity to the planar cover portion for more prominent display of the comestible.

2. The package containing a comestible as claimed in claim 1 wherein said radial tacking corrugation includes an evacuating surface for insertion of an evacuation needle to form an evacuation needle hole for supplying a vacuum to the sealed package.

3. The package containing a comestible as claimed in claim 2 wherein said radial tacking corrugation extends through and connects each of said congruent corrugations and said evacuating surface is disposed near the outermost of said congruent corrugations for ease of sealing said evacuation needle hole.

4. A package containing a comestible, said package comprising:

an integrally formed plastic base member; and an integrally formed plastic top member;

said base member including a substantially centrally disposed comestible receptacle for receiving and supporting the comestible, said comestible receptacle having a transverse cross-sectional shape which is substantially congruent with the transverse cross-sectional shape of the comestible for a substantially snug fit of the comestible therein, said comestible receptacle having a comestible supporting bottom portion and side wall portions connected to said bottom portion, an oppositely disposed pair of said wall portions being of a greater height than the side wall portions normal thereto to form oppositely disposed side wall valley areas disposed normal thereto, said side wall peak and valley areas comprising means for resisting crushing of the package from the top and bottom, for guiding the comestible thereinto during filling, for providing oppositely disposed top and bottom access means for withdrawal of a portion of the comestible, and for holding the bulk of the comestible therein upon opening and removal of a portion of the comestible;

an upwardly projecting engagement lip, said lip having an inside wall formed from said side wall, a lip top portion disposed substantially normal thereto, and an exterior wall connected to said lip portion and extending downwardly therefrom, said lip continuously disposed around the top of said side wall portion, and said lip being of a substantial and substantially uniform width around said side wall for engagement with a mating structure on said top member and said engagement lip comprising means for further cooperative resisting crushing of the package from the top and bottom, for cooperating with the peak areas of the base member to guide the comestible into the comestible receptacle of said base member, for providing oppositely disposed top and bottom access means for withdrawal of a portion of the comestible, and for cooperation with said peak areas of said side wall of said base portion to hold the bulk of the comestible therein upon opening and removal of a portion of the comestible; and an integrally formed lip reenforcement flange projecting exteriorly of and substantially normal to said upwardly projecting lip, said lip reenforcement flange projecting from the bottom of said lip exterior wall throughout substantially the entirety of the circumference thereof;

said base member bottom portion including a plurality of integrally formed congruent corrugations disposed around at least the periphery of said base member bottom portion to permit said bottom portion to flex to accommodate variances in the longitudinal dimension of the comestible to be contained by the package in order to provide a substantially snug fit of the comestible disposed between said bottom portion of said base member and said planar portion of said cover of said top member; and said integrally formed top member including a substantially centrally disposed comestible cover for covering said comestible and having a transverse cross-sectional shape which is substantially congruent with the transverse cross-sectional shape of the comestible for a substantially snug fit of the comestible therein, said comestible cover having a substantially planar portion for confining the top of the comestible and having cover side wall portions connected to and extending downwardly from said planar portion, and oppositely disposed pair of said cover side wall portions being of greater length than the side wall portions disposed normal thereto to form oppositely disposed top member side wall peak areas and oppositely disposed top member side wall valley areas, which are respectively of a size, shape and circumferential disposition to correspond to those of said base member peak areas and base member valley areas;

a lip engagement rim having a rim top portion normally disposed and projecting outwardly from the bottom surface of said top member side wall and having an exterior rim wall extending downwardly from said rim top portion cover to have a size, shape and circumferential disposition for matingly engaging said lip of said base member; and an integrally formed lip engagement rim re-enforcement flange projecting exteriorly of and substantially normal to the bottom of said exterior rim wall of said lip engagement rim and having size, shape and disposition for mating engagement with said lip re-enforcement flange of said base member.

5. The package containing a comestible as claimed in claim 1 wherein said exterior wall of said engagement lip of said base member is disposed substantially parallel to said inside wall of said engagement lip.

6. The package containing a comestible as claimed in claim 5 wherein said exterior rim wall of lip engagement rim extends substantially parallel to said cover portion side wall.

7. The package containing a comestible as claimed in claim 1 wherein said engagement lip further comprises at least one locking indentation formed in said exterior wall of said lip and in a part of said lip disposed radially from said side wall peak areas.

8. The package containing a comestible as claimed in claim 7 wherein said lip engagement rim has at least one indentation in the exterior rim wall and is of a size, shape and radial disposition for mating engagement with said at least one locking indentation of said lip of said base member.

9. The package containing a comestible as claimed in claim 1 wherein said top member comprises a transparent plastic material.

10. The package containing a comestible as claimed in claim 4 wherein said congruent corrugations are connected by at least one radially disposed tacking corrugation for urging said congruent corrugations in an upward direction to form a spring-like bottom structure for urging the top of the comestible into substantial proximity to said planar portion of said cover member for more prominent display of the comestible and for greater ease of evacuation.

11. The package containing a comestible as claimed in claim 10 wherein said radial tacking corrugation includes an evacuating surface for insertion of an evacuation needle for supplying a vacuum to the sealed package.

12. The package containing a comestible as claimed in claim 11 wherein said radial tacking corrugation extends through and connects each of said congruent corrugations and said evacuating surface is disposed near the outermost of said congruent corrugations for ease of sealing the evacuation needle hole.

13. The package containing a comestible as claimed in claim 4 wherein said lip re-enforcement flange includes an aperture therein for hanging the package.

14. The package containing a comestible as claimed in claim 13 wherein said lip re-enforcement flange is of extended length on one side of said comestible receptacle lateral of a side wall portion that is adjacent said side wall valley area and said aperture for hanging the package is disposed in said extended length portion.

15. The package containing a comestible as claimed in claim 4 wherein the uppermost extremities of said matingly engaging peak areas of said top member are disposed substantially in the plane of the planar portion of the cover of said top member.

16. The package containing a comestible as claimed in claim 15 wherein said matingly engaging peak areas of said top member are of a truncated shape to extend a substantial distance around the perimeter of said cover of said top member for improved engagement between said lip of said base member and said lip engagement rim of said top member.

17. The package containing a comestible as claimed in claim 4 wherein said lip engagement rim and said mating lip have no acute angles for improved engagement with each other.

18. The package containing a comestible as claimed in claim 4 wherein said comestible receptacle of said base member and said cover of said top member are round in transverse cross-sectional shape.

19. The package containing a comestible as claimed in claim 4 wherein said lip of said base member comprises two lip portions which are of the shape of an arc of a circle, which are disposed around said side walls of said base member and which extend upwardly at the chord portion of the arc and the arc of the circle is substantially in the same plane.

20. The package containing a comestible as claimed in claim 19 wherein said arc-shaped lip portions are respectively disposed within planes which planes intersect each other at an obtuse angle.

21. The package containing a comestible as claimed in claim 4 wherein said comestible receptacle of said base member and said cover of said top member are square in transverse cross-sectional shape.

22. The package containing a comestible as claimed in claim 4 wherein said lip re-enforcement flange and said engaging lip engagement rim re-enforcement flange respectively extend upwardly on oppositely disposed sides respectively of said base member and said top member to form a respective and engaging lip re-enforcement flange peak and a respective lip engagement rim re-enforcement flange peak.

* * * * *